US005356169A

United States Patent [19]

Hue et al.

[11] Patent Number: 5,356,169

[45] Date of Patent: * Oct. 18, 1994

[54] FLEXIBLE AND LENGTH ADJUSTABLE LATERAL GUIDE APPARATUS FOR A CROSS-COUNTRY SKI SHOE

[75] Inventors: Jean Hue, Saint Jorioz; Gerard Graillat, Annecy, both of France

[73] Assignee: Salomon S.A., Annecy Cedex, France

[ * ] Notice: The portion of the term of this patent subsequent to Feb. 19, 2008 has been disclaimed.

[21] Appl. No.: 745,406

[22] Filed: Aug. 15, 1991

Related U.S. Application Data

[60] Division of Ser. No. 581,198, Sep. 9, 1990, Pat. No. 5,088,756, which is a continuation of Ser. No. 271,515, Nov. 15, 1988, abandoned.

[30] Foreign Application Priority Data

Nov. 18, 1987 [FR] France ..... 87 15950

[51] Int. Cl.[5] ..... A63C 5/04; A63C 5/06

[52] U.S. Cl. ..... 280/607; 280/615

[58] Field of Search ..... 280/602, 607, 609, 613, 280/614, 615, 617, 627, 631, 632, 633, 634, 636, 608; 36/114, 115, 117

[56] References Cited

U.S. PATENT DOCUMENTS

| | | | |
|---|---|---|---|
| 4,129,319 | 12/1978 | Strohmeier | 280/615 |
| 4,235,452 | 11/1980 | Linecker | 280/615 |
| 4,310,170 | 1/1982 | Linecker | 280/607 X |
| 4,312,141 | 1/1982 | Mayer et al. | 36/117 |
| 4,487,427 | 11/1984 | Salomon | 280/615 |
| 4,514,916 | 5/1985 | Aarflot | 36/117 |
| 4,714,267 | 12/1987 | Abondance et al. | 280/615 |
| 4,836,572 | 6/1989 | Pozzobon | 280/613 |
| 4,842,293 | 6/1989 | Rochard | 280/636 X |
| 4,848,786 | 7/1989 | Mankau | 280/602 |
| 4,926,953 | 5/1990 | Platt | 180/68.5 |
| 4,941,675 | 7/1990 | Provence | 280/615 |
| 4,993,741 | 2/1991 | Provence et al. | 280/615 |
| 5,088,756 | 2/1992 | Hue et al. | 280/615 |

FOREIGN PATENT DOCUMENTS

| | | | |
|---|---|---|---|
| 214326 | 3/1961 | Austria | 280/607 |
| 0131234 | 1/1985 | European Pat. Off. | 280/615 |
| 1922960 | 11/1970 | Fed. Rep. of Germany | 280/602 |
| 2815167 | 10/1978 | Fed. Rep. of Germany | 280/615 |
| 3527219 | 2/1986 | Fed. Rep. of Germany | 280/615 |
| 2338719 | 2/1977 | France | 280/615 |
| 2483240 | 12/1981 | France | 280/615 |
| 2565116 | 12/1985 | France | 280/615 |
| 2590131 | 5/1987 | France . | |
| 2595951 | 9/1987 | France . | |
| 82375 | 9/1953 | Norway | 280/607 |
| 99020 | 9/1961 | Norway | 280/607 |

*Primary Examiner*—Brian L. Johnson

*Attorney, Agent, or Firm*—Sandler, Greenblum & Bernstein

[57] ABSTRACT

Apparatus for connection to a cross-country ski for laterally guiding a ski shoe having a front end attached to the ski at a position forwardly of the rear of the shoe whose heel is vertically movable on the ski in the longitudinal median plane thereof includes a longitudinally extending guide rib adapted to cooperate with a longitudinal groove of complementary shape in the sole of the ski shoe. The groove successively includes, from front to rear, a first region beneath the toes of the foot of the wearer of the shoe, a second region beneath the ball of the foot of the wearer, a third region beneath the arch of the foot of the wearer, and a fourth region beneath the the heel of the foot of the wearer. The rib has opposite lateral sides defining the width of the guide, and a top surface defining the height of the guide. Both the slope of the sides relative to the longitudinal median plane of the ski, and the height of the guide, are nonconstant functions of the length of the guide. The length of the guide rib can be modified to accommodate different shoe lengths. Specifically, the end of the rib is configured to facilitate the breakage of predeterminate section(s) of the rib, depending upon the particular shoe size with which the rib is to be used. Such configuration can include a number of transverse score lines at which point an unneeded end section of the guide rib can be broken off.

21 Claims, 6 Drawing Sheets

FIG. 1
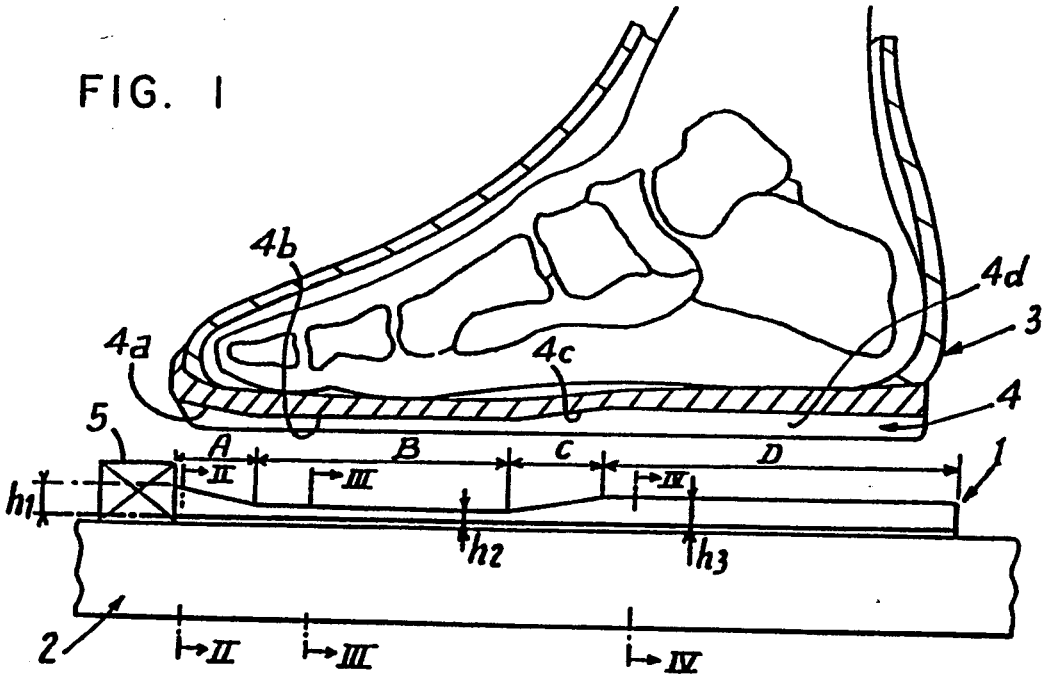
FIG. 2
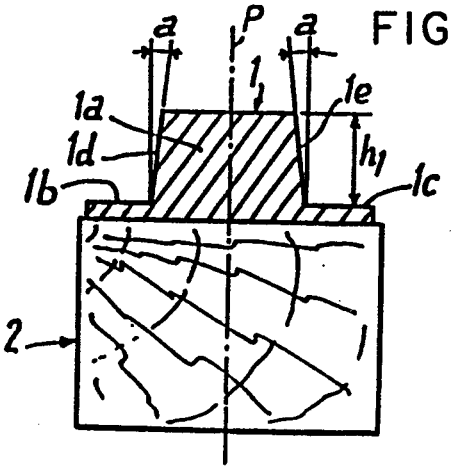
FIG. 3
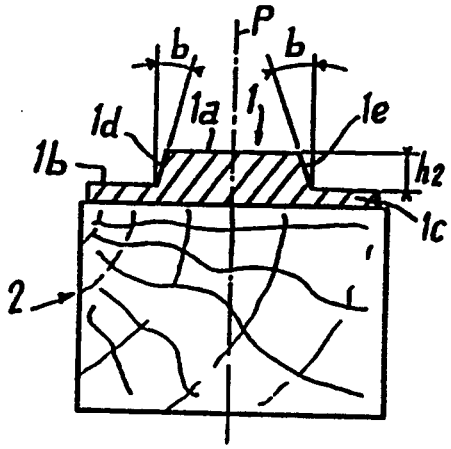
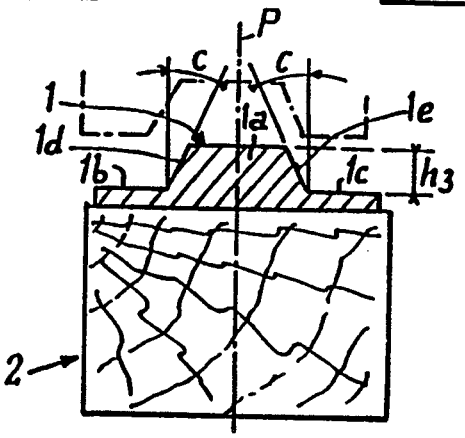
FIG. 4

FLEXIBLE AND LENGTH ADJUSTABLE LATERAL GUIDE APPARATUS FOR A CROSS-COUNTRY SKI SHOE

CROSS-REFERENCE TO RELATED APPLICATIONS

This is a division of application Ser. No. 07/581,198, filed on Sep. 9, 1990, now U.S. Pat. No. 5,088,756, issued on Feb. 18, 1992, which is a continuation of application Ser. No. 07/271,515, filed on Nov. 15, 1988, now abandoned.

BACKGROUND OF THE INVENTION

1. Field of Invention

This invention relates to a lateral guide apparatus for a cross-country ski, and a ski shoe cooperable therewith, the ski shoe having a front end attached to the ski and a rear end which is vertically moveable on the ski.

2. Description of Background and Relevant Information

Various types of apparatus are known for guiding the lateral displacement of a ski shoe whose toe is connected to a cross-country ski. Certain of these rely upon a longitudinal guide rib mounted on, or integral with, the upper surface of the ski. Such rib cooperates with a longitudinal groove of a complementary shape in the sole of the cross-country shoe so as to guide its lateral displacement during downward vertical movement of the heel into engagement with the ski.

It is an object of the present invention to provide new and improved apparatus for guiding the lateral displacement of a ski shoe wherein the efficacy of the apparatus is improved.

SUMMARY OF THE INVENTION

Apparatus according to the present invention is adapted to be connected to a cross-country ski for laterally guiding a ski shoe having a front end attached to the ski at a position forwardly of the rear of the shoe which is vertically moveable on the ski in the longitudinal median plane thereof. The apparatus includes a longitudinally extending guide rib adapted to cooperate with a longitudinal groove of complementary shape in the sole of the ski shoe, the groove successively including, from front to rear, a first region beneath the toes of the foot of the wearer of the shoe, a second region beneath the ball of the foot of the wearer, a third region beneath the arch of the foot of the wearer, and a fourth region beneath the heel of the foot of the wearer. The rib has opposite lateral sides defining the width of the guide, and a top defining the height of the guide. Both the slope of the sides relative to the longitudinal median plane, and the height of the guide are nonconstant functions of the length of the guide.

Preferably, the rib, in a longitudinal direction from front to rear, successively includes a first section whose height decreases in the rearward direction and which is adapted to cooperate with the sole area of the shoe corresponding to the toes of the wearer, a second section of substantially constant height adapted to cooperate with the sole area of the shoe corresponding substantially to the head of the metatarsus, and a third section whose height increases in the rearward direction. The rib may also include a fourth section extending rearwardly of the third section and adapted to cooperate with the sole area of the shoe corresponding to the heel of the wearer. The fourth section has a constant height no greater than the height at the junction between the third and fourth sections. The height of the fourth section may be constant along its length; or, alternatively, the height of the fourth section decreases in the rearward direction.

Preferably, the height of the third section increases monotonically in the rearward direction over its entire length. Alternatively, the third section of the guide rib is constituted by a vertical step that defines the junction between the second section and the fourth section.

In an embodiment of the invention, the top of each of the first and third sections of the rib may have a longitudinal profile that is curved to define an upwardly directed concavity. The top of the second section of the rib may have a longitudinal profile that is curved to define an upwardly directed concavity.

The length of the first section of the rib may range from about 40–60 mm., and its height may range from about 5–25 mm.. The length of the second section of the rib may range from about 80–120 mm., and its height may not be greater than about 15 mm. The length of the third section of rib may range from about 5–25 mm., and its height may range from about 3–13 mm. In a preferred embodiment, the length of the first section is about 50 mm, and the maximum height of the first section is about 15 mm. The length of the second section is about 100 mm.; and the height of the second section is about 5 mm. The length of the third section is about 13 mm.; and the maximum height of the third section is about 8 mm.

In another preferred embodiment, the angle of inclination of the lateral surfaces of the first section of the rib with respect to the median plane is approximately 5 degrees; the angle of inclination of the lateral surfaces of the second section of the rib with respect to the median plane is approximately 15 degrees; and the angle of inclination of the lateral surfaces of the third section of the rib with respect to the median plane is approximately 25 degrees.

In accordance with the present invention, the transverse cross-section of the rib may be in the form of an isosceles trapezoid.

In another embodiment of the present invention, the lateral side surfaces of the rib may be curved.

This being the case, the lateral transverse cross-section of the rib at the front end of the first section is preferably in the form of a pointed arch constituted by two arcs of a circle intersecting at the apex of the rib along the median plane of the ski, and the junction between the first section and the second section being in the form of an arc having an upwardly directed convexity. In the case where the second section has a uniform transverse cross-section, the transverse cross-section at the rear end of the third section is an arc whose curvature is smaller than the curvature of the arc at the junction between the first and second sections.

In this instance, the second section may have a uniform transverse cross-section, in which case the transverse cross-section at the rear end of the third section is an arc whose curvature is smaller than the curvature of the arc at the junction between the first and second sections.

In another embodiment of the present invention the rib may be sub-divided into two longitudinal parallel parts by a longitudinal groove extending over the entire length of the rib.

In yet another embodiment, the rib may be a part of a plate adapted to be applied to the upper surface of the ski, in which-case the plate includes opposite lateral wings which extend from the rib and are supported on the top of the ski, preferably the wings of the plate in the fourth section of the rib are transversely scored to produce zones of weakness that facilitate breakage of the rib for adjusting the length of the plate to the length of the shoe, and wherein the plate is transversely scored at the junction between the third and fourth sections for facilitating breaking.

In a related embodiment of the present invention, wherein, in the fourth section of the rib, the wings of the plate are transversely scored to produce a zone of weakness that facilitate breakage of the rib for adjusting the length of the plate to the length of the shoe, the plate may be transversely scored at the junction between the third and fourth sections for facilitating breaking.

In accordance with the present invention, the rib may be part of plate adapted to be applied to the upper part of the ski, said plate having means on its lower surface adapted to over-lie the sides of the ski, or may be in combination with a ski wherein the rib is integral with the ski.

The present invention is also directed to a cross-country ski shoe having a sole provided with a continuous longitudinal groove having succeeding sections, from front to rear, whose width and depth is a nonconstant function of the length of the groove.

The present invention is also directed to an apparatus adapted to be connected to a cross-country ski for laterally guiding a ski shoe having a front end attached to the ski at a position forwardly of the rear of the shoe whose heel is vertically movable on the ski in the longitudinal median plane thereof which includes a longitudinally extending guide rib adapted to cooperate with a longitudinally extending groove of complementary shape in the sole of the ski shoe wherein the groove successively includes, from front to rear, a first region beneath the toes of the foot of the wearer of the shoe, a second region beneath the ball of the foot of the wearer, a third region beneath the arch of the foot of the wearer, and a fourth region beneath the heel of the foot of the wearer; and wherein the rib has opposite lateral sides defining the width of the guide, and a top defining the height of the guide, wherein both the slope of the sides relative to said longitudinal median plane and the height are nonconstant functions of the length of the guide, and wherein the guide rib may be solid, and the guide rib is provided with transverse notches in the side thereof facing the shoe.

BRIEF DESCRIPTION OF THE DRAWINGS

Nonlimiting embodiments of the present invention are described with reference to the accompanying drawings wherein:

FIG. 1 is a schematic sectional .side view of lateral guide apparatus according to the present invention applied to a cross-country ski, and of a shoe for use therewith according to the present invention;

FIG. 2 is a transverse cross-section taken along line II—II of FIG. 1;

FIG. 3 is a transverse cross-section taken along line III—III of FIG. 1;

FIG. 4 is a transverse cross-section taken along line IV—IV of FIG. 1;

DESCRIPTION OF PREFERRED EMBODIMENTS

Figure 5:
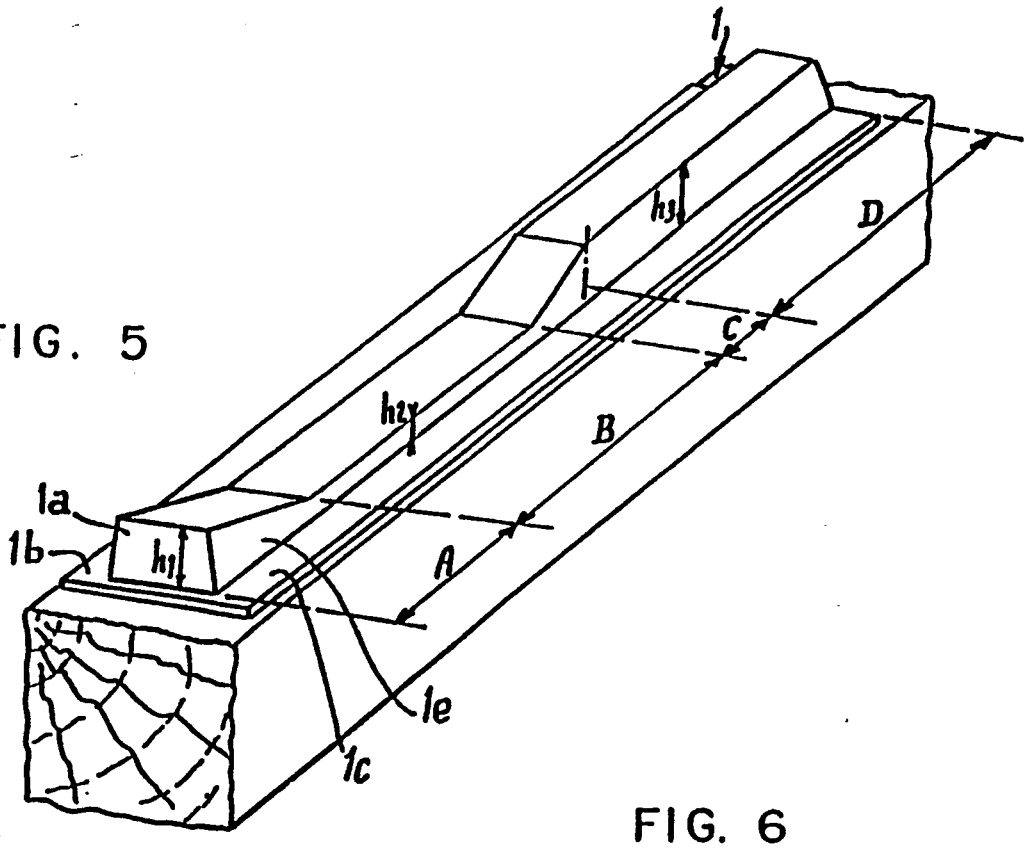
FIG. 5 is a perspective view of the lateral guide apparatus of FIG. 1.
Figure 6:
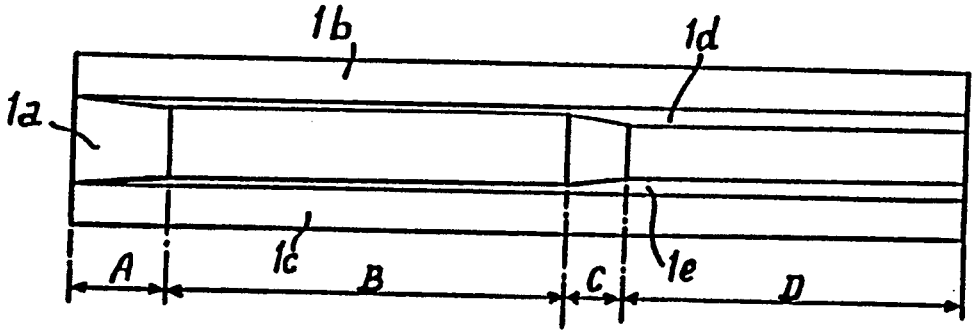
FIG. 6 is a top view of the lateral guide apparatus of FIG. 1.

Lateral guide apparatus according to the present invention, designated by reference numeral 1 in FIGS. 1–6, is constituted by a plate, normally separate from the ski, and preferably formed of plastic material which is attached by the usual means on the upper surface of cross-country ski 2 having a right rectangular transverse cross-section.

Alternatively, lateral guide apparatus 1 may be integral with ski 1 by being molded therewith, or may be machined into the upper surface of the ski.

Apparatus 1 is adapted to provide lateral guidance of cross-country shoe 3 during the practice of cross-country skiing by guiding lateral displacement of the shoe during repetitive upward and downward movement of the heel of the shoe relative to the ski. To this end, the sole of shoe 3 contains longitudinal groove 4 that is complementary to and cooperates with lateral guide apparatus 1. The front end of shoe 3 is fixed in a conventional manner to the ski by means of binding 5 mounted on the ski so that the heel of shoe 3 is capable of moving freely, at least vertically, relative to the top surface of the ski.

The central portion of the plate constituting lateral guide apparatus 1 comprises longitudinal guide rib **1*a* whose transverse cross-section includes a central region that has a polygonal or curved shape, and opposite lateral sides on the lower portion of the rib in the form of two lateral horizontally disposed opposed wings 1*b*, 1*c* which engage the upper surface of ski 2, and which extend substantially laterally on each side of the central region. In the embodiment of the invention shown in FIGS. 1–6, the central region of the transverse cross-section of rib 1*a*** is in the form of an isosceles trapezoid.

In this embodiment, the lateral guide apparatus is symmetrical with respect to the longitudinal and vertical median plane of symmetry P of ski 2. However, this construction is only optional; and plate 1 may have a transverse cross-section which is not symmetrical with respect to the median plane.

The present invention provides for longitudinal variations in both the height-of central longitudinal rib 1*a*, and the inclination of lateral surfaces 1*d*, 1*e* of rib 1*a* with respect to the longitudinal median plane. In first front section A of the rib, whose length ranges from about 40–60 mm., and preferably is equal to about 50 mm. The height h of rib 1*a* decreases monotonically, rearwardly, from a maximum height h1, adjacent the front end of plate 5 (i.e., the end adjacent to the binding) to a height h2 at the junction between section A and adjacent second section B. Height h1 may range from 5 to 25 mm. and preferably is equal to about 15 mm. Height h2, should not exceed about 15 mm. and preferably is equal to about 5 mm. In first front section A, inclination angle a, which is the angle between respective lateral inclined surfaces 1*d*, 1*e* of the rib 1*a* and median plane P, is relatively small. Preferably, this angle is equal to about 5° (see FIG. 2).

Rearward of first front section A of decreasing height is second section B whose length ranges from about 80–120 mm., and preferably is equal to about 100 mm. In second section B, height h2 should not exceed about 15 mm. and preferably is equal to about 5 mm.; and the lateral surfaces 1*d*, 1*e* of rib 1*a* are more inclined with respect to median plane P. In section B, the inclination angle h is typically about 15° (see FIG. 3).

Rearward of second section B of height h2 is third section C whose length may range from about 5–25 mm., and preferably is equal to about 15 mm. In Section C, the height of rib 1*a* increases progressively in the rearward direction from the minimum value h2 to a maximum value h3 which is in the range from about 3–13 mm. and preferably, is equal to about 8 mm. In section C, the lateral surfaces 1*d*, 1*e* of the rib 1*a* are more inclined with respect to median plane P. Typically, inclination angle c in section C is about 25° (see FIG. 3).

Rearward of third section C is fourth section D which extends rearwardly to the end of plate 1 terminating under the heel of the shoe. In this section, the height of the rib may remain constant and have the value h3.

Preferably, sections A, B, C, D, are integrally connected in a continuous manner; and these sections are adapted to cooperate with corresponding complementary sections of longitudinal groove 4 in the sole of shoe 3. More particularly, groove 4 comprises successively, from the front towards the rear of the shoe, front section 4*a* of a depth that decreases from the front towards the rear and of length substantially equal to that of first front section A of plate 1. Rearward of front section 4*a* is second section 4*b* of a constant depth, and of a length which is substantially equal to that of second section B of plate 1. Rearward of section 4*b* is third section 4*c* of a depth which increases from front to rear, and of a length substantially equal to that of third section C of plate 1. Finally, fourth section 4*d* is rearward of the third section and has a constant depth extending to the rear edge of the sole. As shown in FIG. 1, fourth rear section D of plate 1 may be longer than the fourth section 4*d* of groove 4 in the sole of the shoe. As a consequence, plate 1 may extend slightly beyond the heel of the shoe.

The four sections A, B, C, D of guide plate 1 have lengths functionally related to the morphology of the foot of the wearer of the ski shoe. First front section A extends substantially in a support zone beneath the toes of the foot of the wearer of the shoe. In this zone, close to binding 5, the essential function of rid 1*a* of plate 1 is to precisely guide the shoe against lateral displacement. Because the front end of the shoe is fixed to the ski, first front section 4*a* of groove 4 of the sole will always remain partially engaged with guide rib 1*a* throughout the entire pivotal movement of the heel of shoe 3 with respect to the ski. As a result, shoe 3 cannot laterally shift with respect to the median plane P; and this gives the skier perfect control over steering the ski. In the course of the return of the sole of the shoe to a flat position on the ski, the combination of the continuity of rib 1*a* and of the profile of the lateral inclined surfaces 1*d*, 1*e* of the rib allow for a perfect engagement of the shoe on the ski during such return.

Second cross-section B of guide plate 1, in which the rib is of height h2 and is significantly less than the height of the other sections of the plate, allows the sole of the shoe beneath the head of the metatarsus of the foot to approach the snow on each side of the ski. The resultant of the forces of the foot of the skier acting through the ball of the foot on the ski is localized essentially at the location of the head of the first metatarsus. Thus, by permitting the head of the metatarsus to approach the snow on each side of the ski, the lateral stability of the ski is increased all-the-more favoring the course selected by the skier. The reduced height h2 of guide rib 1*a* in second section B offers a compromise between a satisfactory guidance for this zone of the foot, and an optimal lateral stability of the ski when the shoe rests flat on the ski.

The third and fourth sections C, D, under the arch and heel of the foot of the wearer, serve to correctly center the rear half of the sole with respect to the ski during the return of the shoe to a position flat on the ski. In these two sections, lateral surfaces 1*d* and 1*e* are more inclined with respect to the vertical (angle c is 25° for example) than in front section A (where angle a is about 5°). This arrangement enhances recentering of the shoe on the ski when the heel is returned to a flat position on the ski. In fact, if the heel of the shoe undergoes a slight lateral deviation with respect to longitudinal median plane P, the reduced slope of the lateral surfaces 1*d*, 1*e* makes it possible to overcome this deviation as the shoe returns to its flat position. This is shown in FIG. 4 where the shoe is offset laterally with respect to median plane P as shown in chain lines. Such a shaping of guide rib 1*a* makes it possible to avoid any loss of instantaneous guidance, which is contrary to what occurs with noncontinuous guide apparatus.

FIGS. 7–14 illustrate various other alternative embodiments of lateral guide apparatus according to the present invention.

Figure 7:
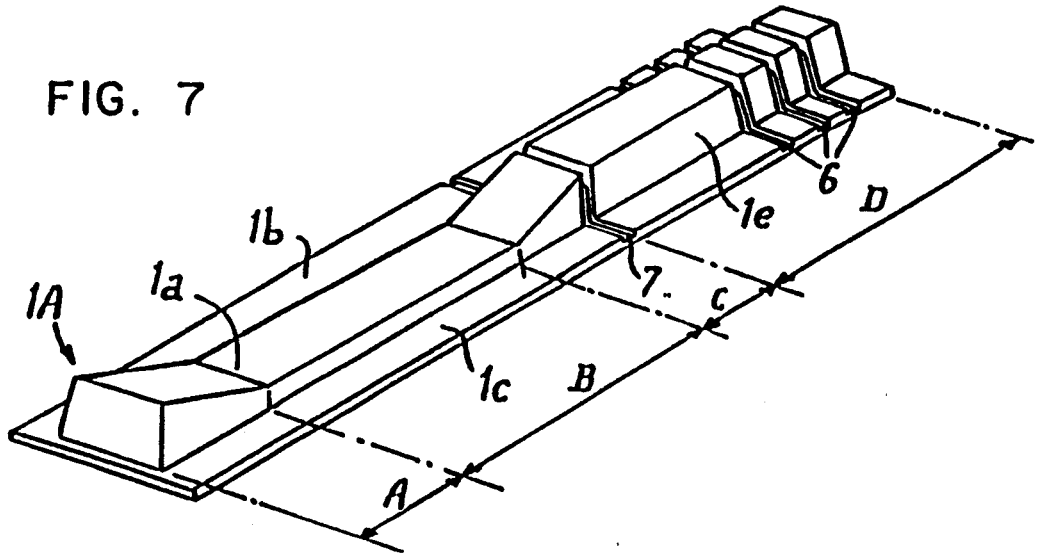
FIGS. 7 and 8 are perspective views of alternative embodiments of the present invention.

In the alternative embodiment of the invention shown on FIG. 7, the upper surface of plate 1A is provided with transverse grooves 6 in fourth rear section D of the plate. That is to say, grooves 6 extend in both the central guide rib 1*a* and in the top of lateral wings 1*d*, 1*c*. These grooves constitute scores in the apparatus which define weakened zones thereby permitting the plate to be broken at such zone to adapt the overall length of the plate to the size of the shoe. Transverse groove 7 of the same type can constitute a weakened zone at the junction between third section C and fourth section D of the plate.

Figure 8:
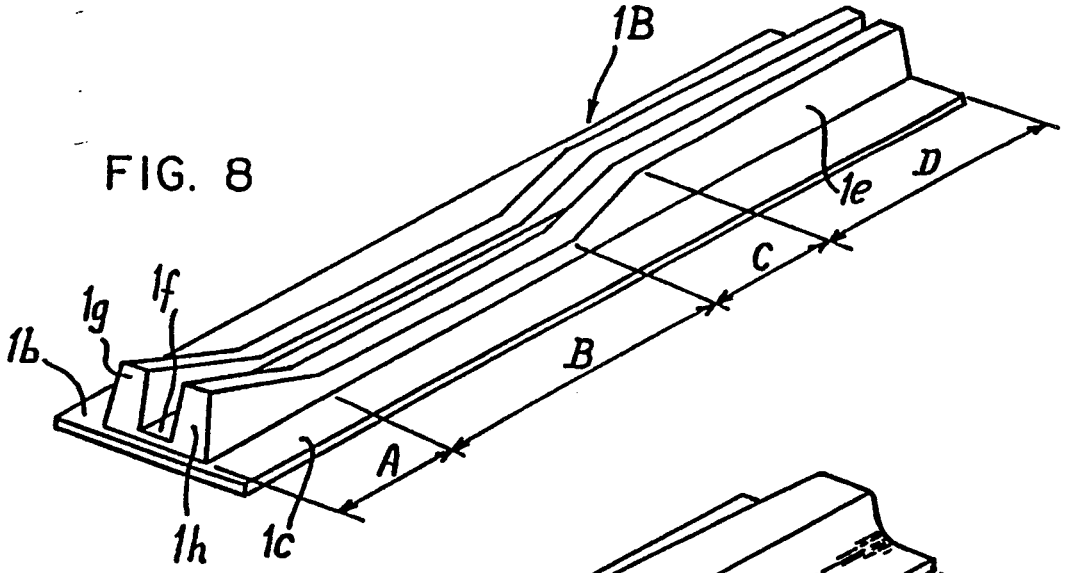

In the embodiment of the invention shown in FIG. 8, the guide rib of plate 1B has the same shape as that shown in FIGS. 1–7, but has a longitudinal groove 1*f* symmetrically located with respect to the median plane of the ski. Groove 1*f* extends over the entire length of plate 1B. As a result, this longitudinal groove divides the longitudinal rib into two parallel sub-ribs 1*g* and 1*h*, each of which has the same transverse profile and is symmetrically located relative to the median plane.

Figure 9:
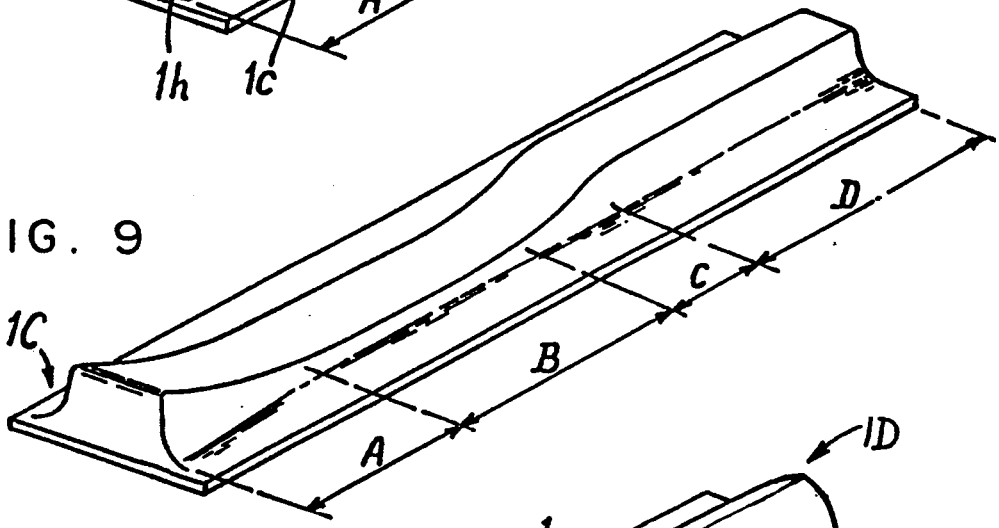
FIGS. 9 and 10 are perspective and elevation views, respectively, of a further embodiment of the present invention.
Figure 10:
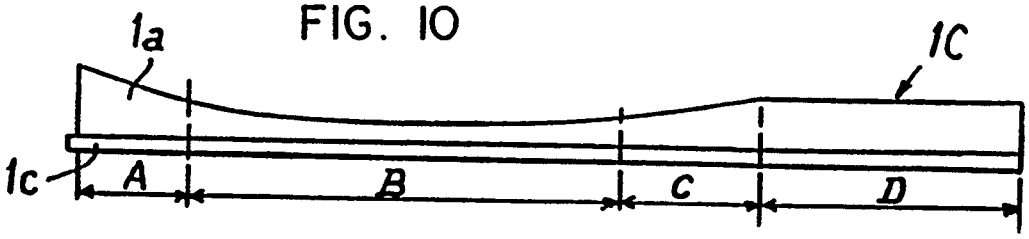

In the alternative embodiment of the invention shown in FIGS. 9 and 10, second section B of the upper surface of the longitudinal rib of guide plate 1*c* has a longitudinally curved profile. Specifically, the profile defines an upwardly opening concavity having a large radius of curvature. Otherwise, stated the height of the longitudinal rib in section B diminishes progressively rearwardly from the junction with section A until a minimum is reached, and then increases progressively rearwardly toward the junction with section C. In a modification of this embodiment, the upper surfaces of first and third sections A and C may also be curved longitudinally and have a large radius of curvature smoothly connecting sections A and C to the upper surface of the second section B.

Figure 11:
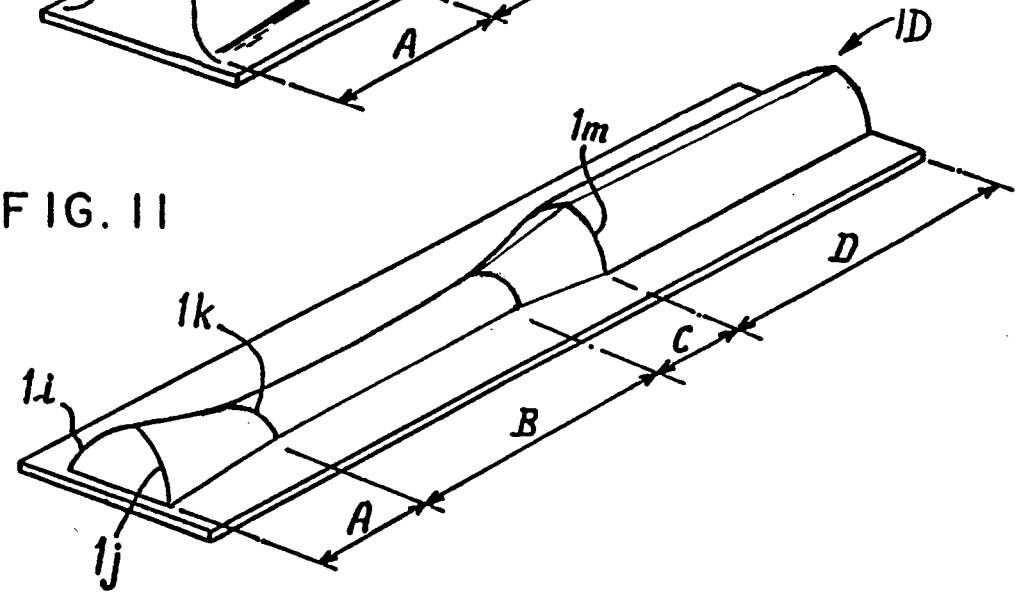
FIGS. 11 and 12 are perspective and elevation views, respectively, of a still further embodiment of the present invention.
Figure 12:
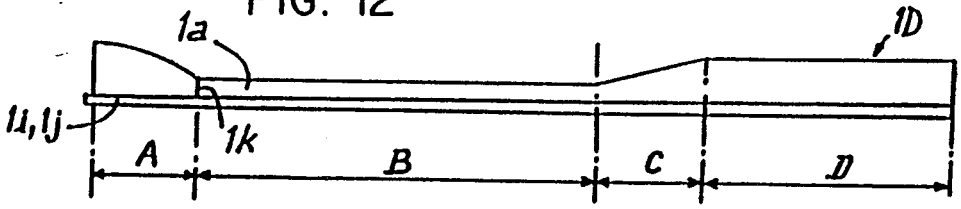

In the alternative embodiment of the invention shown in FIGS. 11 and 12, the transverse cross-section of the rib of guide plate 1D is in the shape of a pointed arch. Lateral inclined surfaces 1*i* and 1*j* of front section A are curved. Preferably, surfaces 1*i* and 1*j* are arcs of circles. The intersection of these surfaces at the forward end of section A is a point of discontinuity lying on the median plane and defines an apex. The transverse cross-section of section A, in the form of a pointed arch, changes progressively in the rearward direction to define, at the junction with second section B, a transverse cross-section in the form of a pointed arch 1*k* having an upwardly turned convexity. First section A preferably has a longitudinally curved profile defining an upwardly turned convexity as shown on FIG. 12.

Second section B, and the two sections C and D of this embodiment, each have transverse cross-sections in the form of pointed arches. Arch 1*m* defining the transverse cross-section of the junction between sections C and D presents an upwardly turned convexity having a radius of curvature greater than that of the radius of curvature of second section B because of the junction of the lower ends of arcs 1*i*, 1*j*, 1*k*, 1*m*, with lateral wings 1*b* and 1*c* which are aligned. Stated otherwise, the curvature of the arcs of arch 1*m* at their angles is less than the curvature of arcs of arch 1*k*.

Figure 13:
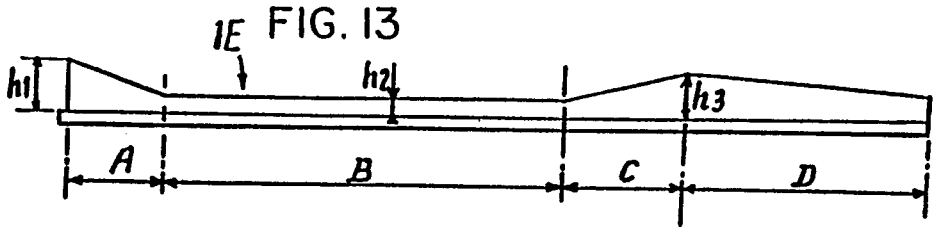
FIG. 13 is an elevation view of a still further embodiment of the present invention.
Figure 14:
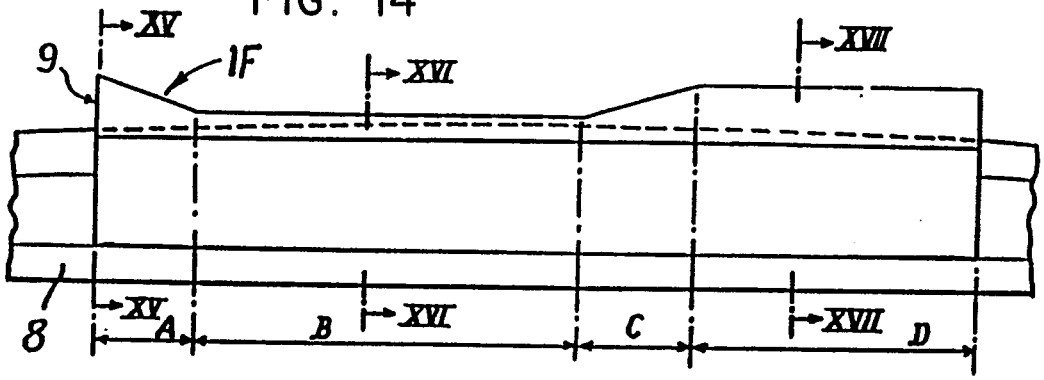
FIG. 14 is a side view of lateral guide apparatus according to the present invention mounted on a cross-country ski having a profiled upper surface.

FIG. 13 shows a further embodiment of the invention wherein the height of fourth section D of guide plate 1E decreases rearwardly from its junction with third section C. The decrease in height is monotonic.

Figure 15:
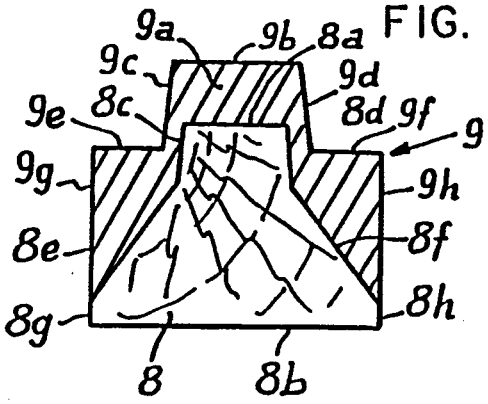
FIG. 15 is a transverse cross-section taken along line XV—XV of FIG. 14.
Figure 17:
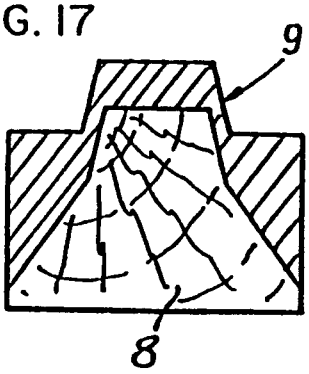
FIG. 17 is a transverse cross-section taken along line XVII—XVII of FIG. 14.
Figure 16:
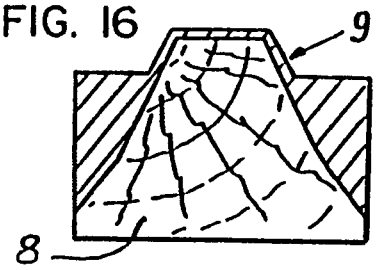
FIG. 16 is a transverse cross-section taken along line XVI—XVI of FIG. 14.
Figure 18:
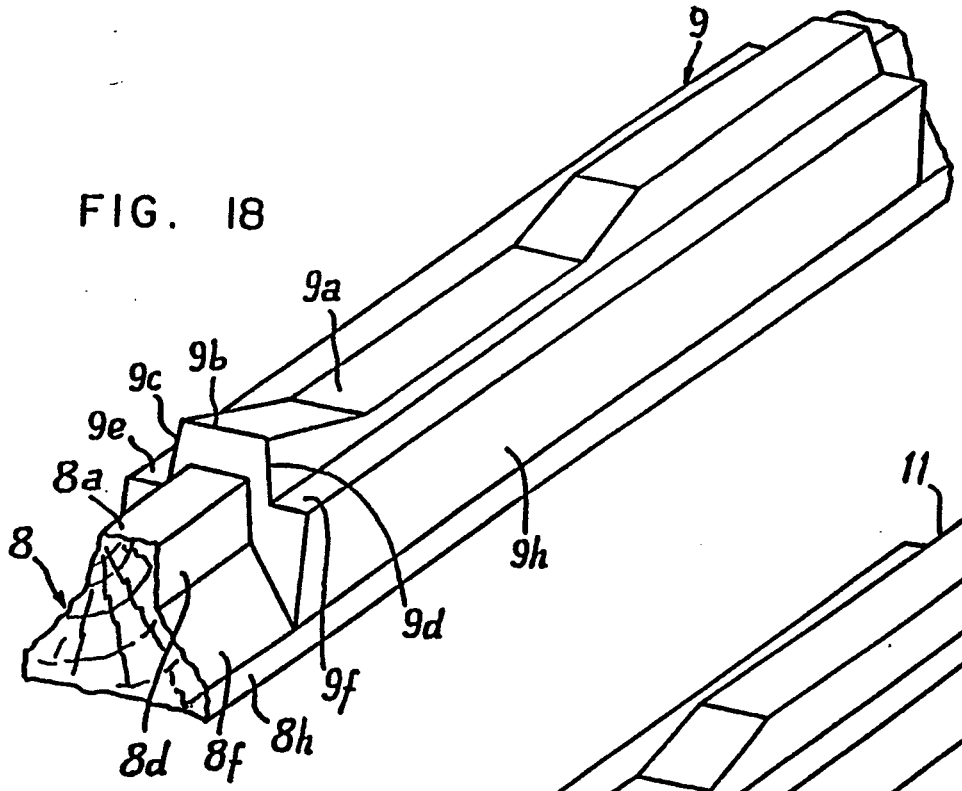
FIG. 18 is a perspective view of the lateral guide apparatus shown in FIGS. 14–16.

In the alternative embodiment of the invention shown in FIGS. 14–18, lateral guide apparatus 1F is mounted on cross-country ski 8 whose transverse cross-section is constituted by two superimposed trapezoids (FIG. 15). Ski 8 thus has upper horizontal surface 8*a* of a width less than that of lower surface 8*b* of the ski. Upper horizontal surface 8*a* is connected to two lateral surfaces 8*c* and 8*d* which are slightly inclined with respect to the longitudinal median plane of the ski to constitute a first upper isosceles trapezoid of relatively small width. The two lateral inclined upper side surfaces 8*c* and 8*d* extend downwardly to intersect two other lateral surfaces 8*e* and 8*f* which are more inclined with respect to the median plane and which define a lower isosceles trapezoid of greater width. Lower inclined surfaces 8*e* and 8*f* are connected, in turn, to sides 8*g* and 8*h* of the ski which have a relatively low height.

Over a portion of the length of ski 8 is superimposed lateral guide apparatus constituted by plate 9 which may be applied to the ski as a separate element, or may be integral with the ski. The upper surface of plate 9 may be configured in accordance with any of guide plates 1, 1B, 1C, 1D or 1F. In general, guide plate 9 comprises longitudinally extending rib 9*a* whose transverse cross-section is in the form of an isosceles trapezoid which overlies upper surface 8*a* of ski 8. Rib 9*a* is defined by horizontal upper surface 9*b* and two laterally displaced inclined surfaces 9*c* and 9*d*. These lateral surfaces extend downwardly to a level below that of upper surface 8*a* of ski 8 where they connect to two lateral horizontal surfaces 9*e* and 9*f* of plate 9. Lateral surfaces 9*e* and 9*f* are respectively connected to vertical side surfaces 9*g* and 9*h* which are coplanar with sides 8*g* and 8*h* of ski 8 to which they are connected. In this embodiment, the height of rib 9*a*, with respect to lateral horizontal surfaces 9*e* and 9*f*, and the angle of inclination of lateral surfaces 9*c* and 9*d* with respect to the median plane of the ski, vary longitudinally along the length of the ski in the same manner as described above in connection with the embodiment illustrated in FIGS. 1–7.

Figure 19:
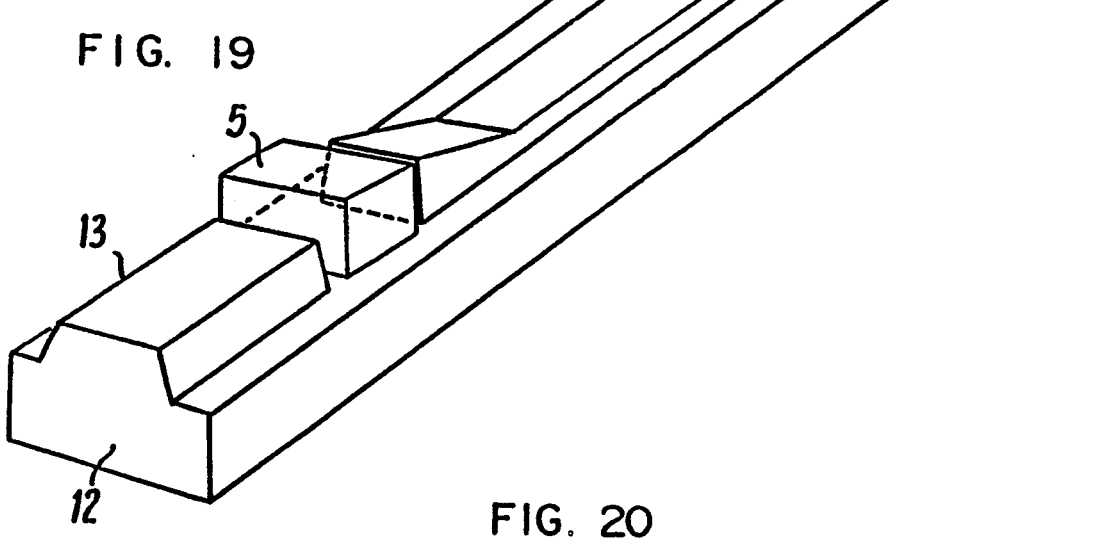
FIG. 19 is a perspective view of a still further embodiment of the present invention.

In an alternate embodiment of the invention shown in FIG. 19, the lateral guide apparatus is constituted by a longitudinal guide rib 11 which is formed integrally with ski 12 which additionally has, on its upper surface, longitudinal rib 13 whose transverse cross-Section is in the form of an isosceles trapezoid. Guide rib 11 is formed in a zone of the upper surface of the ski where longitudinal rib 13 is interrupted to create a space, between the rear of rib 13 and the front end of lateral guide rib 11, sufficient to allow for the mounting of binding 5. In this embodiment, the guide rib 11 has, in the longitudinal direction, the same shape of the guidance rib of plate 1 in the embodiment illustrated in FIGS. 1–7. However, the rib could also be shaped in accordance with the other embodiments disclosed in the present invention, namely FIGS. 8, 9, 11, 12, and 13.

Figure 20:
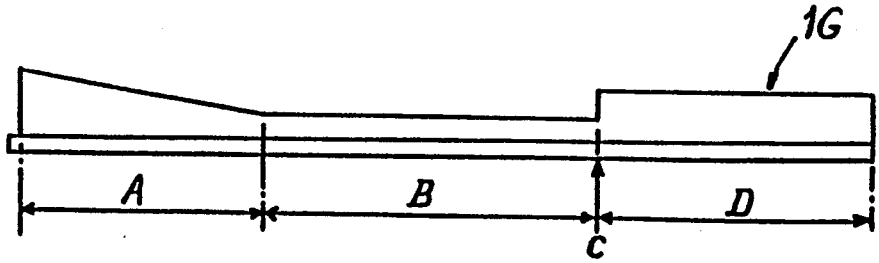
FIG. 20 is an elevation view of a still further embodiment of the present invention.

In a further alternative embodiment of the invention, shown in FIG. 20, the length of the third section C of guide rib 1G approaches zero, and section C is constituted as a step. In this case, the transition between section B and section D is a vertical and transverse plane. This suppression of the transition zone constituting section C is preferably accompanied by elongation of section B.

Figure 21:
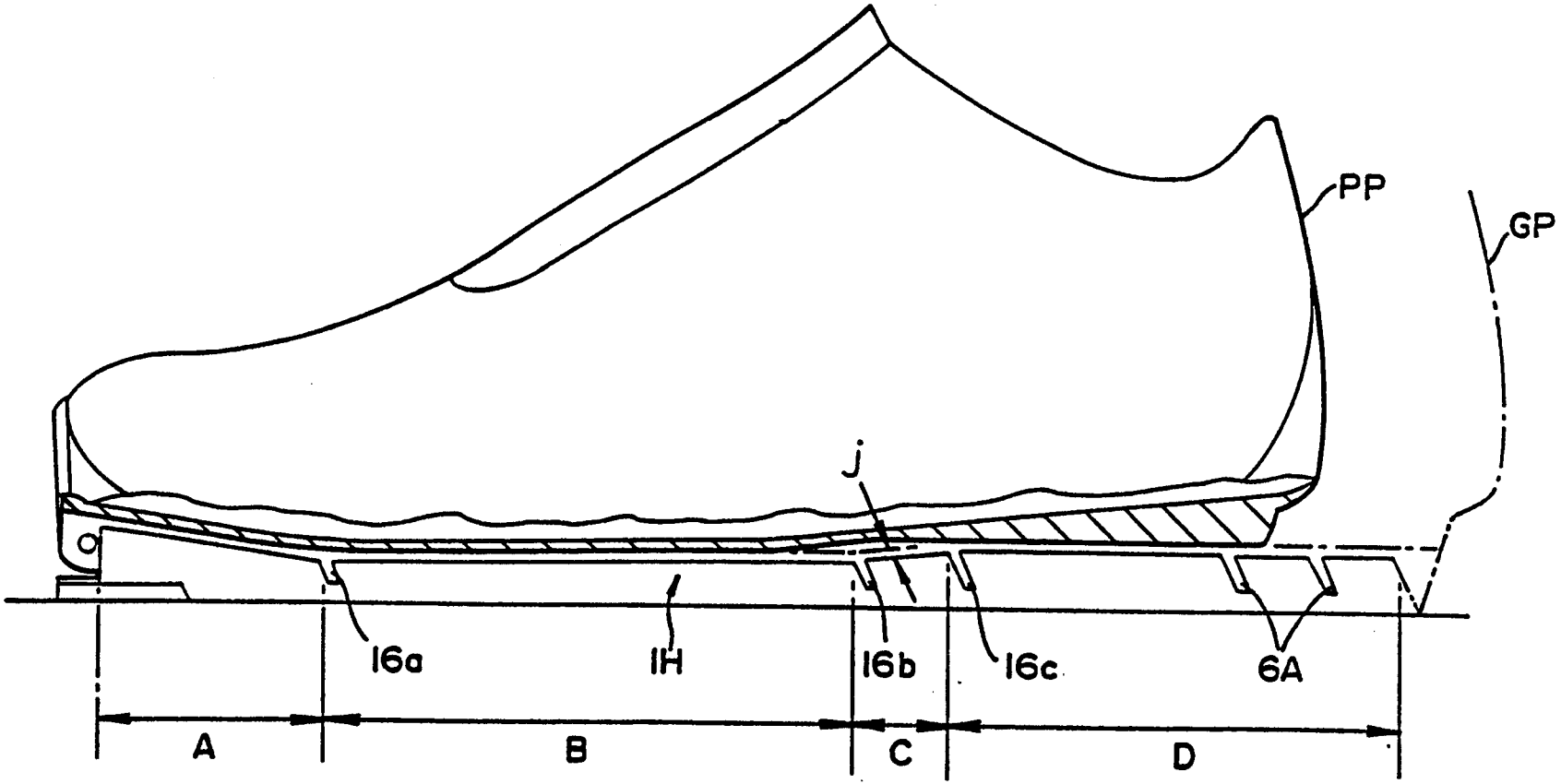
FIG. 21 is a side view of a still further embodiment of guide apparatus according to the present invention showing boots of different sizes, in partial cross-section, and showing means for adjusting the length of the apparatus to accommodate boots of different lengths.

As shown in FIG. 21, the lengths of portions A, B, C, and D of the various embodiments of the guide ribs according to the present invention are selected in a way that permits the same rib to be used for very small as well as for very large sizes of shoes. In practice, the length of portions A, B, and C are fixed, and are calculated in a way to allow optimum guidance for the largest size shoe GP, shown in dotted lines in FIG. 21, as well as the smallest size shoe PP shown in solid lines.

Portion B of the ribs of the-various embodiments thus extends up to the level of the separation of the portion of the shoe or boot corresponding to the plantar arch; and the incline of portion C corresponds to the incline of the plantar arch for the greatest size shoe GP. Portion C is designed to provide minimal play "j" (see FIG. 21) between this portion and the associated portion of shoe GP. Portion A of a rib according to the present invention is designed so as to present minimal play with the associated portion of the boot in the case of the smallest size PP. Preferably, portion D of the rib has two, but optionally may have more than two, shoe size adjustment notches which serve as break points that allow portion D to be shortened in order to reduce its length to accommodate shoes of shorter length. As shown in FIG. 21, the rearmost part of portion D of a rib may be separated from the main portion by notch 6A in order to reduce the length of the rib to a minimum consistent with the smallest size shoe PP. In such case, the rib would not project beyond the heel of the shoe even for the smallest size thereof.

In the case of the largest size shoe GP, optimum guidance is achieved at the level of the plantar arch (i.e., at the level of portion C of a rib). In the case of the smallest size shoe PP, guidance will occur only up to the level of the metatarsus and at the level of the heel; but this is nevertheless very satisfactory, more particularly because portion A of a rib provides the primary guidance for the smallest size PP.

One particularly preferred set of lengths of portions A, B, C, and D is the following: A=50 mm; B=110 mm; and C=20–25 mm.

The smallest incline of the lateral surfaces of the guidance rib in portions A and B is adapted to allow a better guidance (shoe or boot nearest the rib), whereas the more accentuated incline of these lateral inclines at the rear (portions C and D) is adapted to allow a recentering of the shoe or boot.

As shown in FIG. 21, notches 6A in portion D serve to facilitate changing the length of a rib to accommodate shoes of different lengths. Other notches 16*a–c* may be provided in sections A, B, and C, and more particularly in the junction area of adjacent ones of portions A, B, C, D. These notches have the same shape as notches 6A, but are not provided to facilitate breaking of the rib to shorten it. Rather, notches 16*a–c* confer to this rib a greater flexibility or pliability in the longitudinal direction, particularly when the transverse width of the rib is made large to confer rigidity. Such flexibility in the longitudinal direction allows the central rib to adapt easily to the curve of a cross-country ski and facilitates gluing or otherwise fixing the transverse flanges of the rib to the ski.

Although the invention has been described with reference to particular means, materials and embodiments, it should be understood that the invention is not limited to the particulars disclosed, but extends to all equivalents within the scope of the pending claims.

What is claimed is:

1. An apparatus for guiding a ski boot on a ski, said apparatus comprising:

a longitudinally extending guide rib adapted to cooperate with a complementary longitudinally extending groove in the sole of a boot, said guide rib having a predeterminate length and comprising means for facilitating changing of said predeterminate length of said guide rib to a different predeterminate length corresponding to a different complementary longitudinally extending groove in the sole of a different boot, said longitudinally extending guide rib having a predeterminate width defined by least one portion of said guide rib, said means for facilitating changing of said predetermined length of said guide rib comprising at least one score line extending substantially across said predeterminate width at said one portion, said apparatus further comprising a pair of opposite lateral wings extending from said guide rib, said at least one score line extending transversely across said lateral wings.

2. The apparatus of claim 1, said longitudinally extending guide rib comprising at least a rear portion and a front portion, said one portions comprising said rear portion.

3. The apparatus of claim 2, said at least one score line comprises a plurality of longitudinally spaced score lines extending substantially across said predeterminate width at said one portion.

4. The apparatus of claim 3, said longitudinally extending guide rib further comprising a second portion, forward of said one portion, at least one score line extending transversely substantially entirely across said second portion.

5. The apparatus of claim 2, said apparatus being adapted for use with a plurality of boots having different sole lengths, within a range from a shortest length to a longest length, said predeterminate length of said guide rib being at least as long as said longest length, said at least one score line being positioned along said guide rib for defining a length of said guide rib corresponding to said shortest length, whereby said guide rib is adapted to be broken at said one score line corresponding to said shortest length.

6. The apparatus of claim 5, said guide rib comprising a further score line forward of said rear portion.

7. The apparatus of claim 1, each said score line comprising an upwardly open transverse groove.

8. The apparatus of claim 1, said guide rib being substantially solid.

9. The apparatus of claim 1, said lateral wings having a height substantially less than the height of said guide rib at any portion of said rib.

10. The apparatus of claim 1, said means for facilitating changing of said predeterminate length of said guide rib also comprising means for facilitating flexion of said guide rib.

11. The apparatus of claim 1, said apparatus being adapted to be affixed to a ski having a predeterminate camber, said means for facilitating changing of said predeterminate length of said guide rib also comprising means for adapting said guide rib to said predeterminate camber of said ski.

12. The apparatus of claim 1, said apparatus having a length substantially equal to a length of the ski boot.

13. A ski comprising the apparatus of claim 1, said apparatus being positioned on an upper portion of the ski.

14. The apparatus of claim 5, said at least one score line comprising a plurality of longitudinally spaced score lines, each of said plurality of longitudinally spaced score lines corresponding to a corresponding predetermined guide rib length.

15. A ski comprising the apparatus of claim 10, said ski having a predeterminate width, and said guide rib further comprising opposite lateral side surfaces defining a predeterminate rib width along a substantial portion of said guide rib, said rib width being at least approximately one-half the predeterminate width of said ski.

16. A method of changing the length of a longitudinally extending guide rib, said longitudinally extending guide rib adapted to cooperate with a complementary longitudinally extending groove in the sole of a boot, at least one score line extending transversely across said guide rib, said method comprising the step of:

breaking said guide rib at said one score line.

17. The method of claim 16, said guide rib having at least a front portion and a rear portion, said one score line being located in said rear portion, wherein said step of breaking said guide rib at said one score line comprises breaking said guide rib at said one score line in said rear portion of said guide rib.

18. The method of claim 17, said guide rib being adapted for use with a plurality of boots having different sole lengths, within a range from a shortest sole length to a longest sole length, said guide rib having a predeterminate length at least as long as said longest sole length, said at least one score line being positioned along said guide rib for defining a length of said guide rib corresponding to said shortest length, whereby said step of breaking said guide rib comprises breaking said guide rib at said at least one score line to adapt said guide rib for use with a predeterminate boot having a corresponding sole length.

19. The method of claim 16, said step of breaking said guide rib at said one score line comprising breaking said guide rib at said one score line to confer to said guide rib a length corresponding to said complementary longitudinally extending groove in the sole of the boot.

20. A method of changing the length of a longitudinally extending guide rib and placing said guide rib upon a ski, said longitudinally extending guide rib being adapted to cooperate with a complementary longitudinally extending groove in the sole of a boot, at least one score line extending transversely across said guide rib, said method comprising the steps of:

breaking said guide rib at said one score line; and affixing said guide rib upon a ski.

21. The method of claim 20, said step of breaking said guide rib at said one score line comprising breaking said guide rib at said one score line and removing an end of said guide rib that had been rearward of said one score line for providing a shortened length of said guide rib for accommodating said guide rib to a predeterminate boot size corresponding to said shortened length of said guide rib.

* * * * *